US006625843B2

(12) United States Patent
Kim et al.

(10) Patent No.: US 6,625,843 B2
(45) Date of Patent: Sep. 30, 2003

(54) REMOTE-CONTROLLED MOBILE CLEANING APPARATUS FOR REMOVAL AND COLLECTION OF HIGH RADIOACTIVE WASTE DEBRIS IN HOT-CELL

(75) Inventors: Ki-Ho Kim, Daejeon-si (KR); Jang-Jin Park, Daejeon-si (KR); Myung-Seung Yang, Daejeon-si (KR); Hyun-Soo Park, Daejeon-si (KR)

(73) Assignees: Korea Atomic Energy Research Institute, Daejon (KR); Korea Electric Power Corporation, Seoul (KR)

( * ) Notice: Subject to any disclaimer, the term of this patent is extended or adjusted under 35 U.S.C. 154(b) by 49 days.

(21) Appl. No.: 09/863,444

(22) Filed: May 24, 2001

(65) Prior Publication Data

US 2002/0017005 A1 Feb. 14, 2002

(30) Foreign Application Priority Data

Aug. 2, 2000 (KR) ..... 00-44768

(51) Int. Cl.[7] ..... A47L 5/00
(52) U.S. Cl. ..... 15/319; 15/340.1
(58) Field of Search ..... 15/319, 340.1, 15/339, 304

(56) References Cited

U.S. PATENT DOCUMENTS 4,306,329 A * 12/1981 Yokoi ..... 15/319
5,147,002 A * 9/1992 Hughes ..... 15/319
5,284,522 A * 2/1994 Kobayashi et al. ..... 134/18
5,341,540 A * 8/1994 Soupert et al. ..... 15/319
5,561,883 A * 10/1996 Landry et al. ..... 15/302
5,787,545 A * 8/1998 Colens ..... 15/319
5,815,880 A * 10/1998 Nakanishi ..... 15/319
6,119,057 A * 9/2000 Kawagoe ..... 701/23

* cited by examiner

*Primary Examiner*—Terrence R. Till
(74) *Attorney, Agent, or Firm*—Arent Fox Kintner Plotkin & Kahn

(57) ABSTRACT

A remote-controlled mobile cleaning device for removal and collection of high radioactive waste debris in a spent nuclear fuel process and fabrication area, such as a hot-cell, is disclosed. The device includes navigation means for moving it to the desired cleaning location and climbing over such obstacles as electrical cables and pneumatic tubes placed on the hot-cell floor to be cleaned, suction and collection means for dislodging, filtering, and capturing high radioactive waste debris, and cover means for protecting suction and collection means. The device that is operated by remote control cleans and collects loose dry spent nuclear fuel powder and other high-radioactive waste debris adhered to both the contaminated in-cell floor and the in-cell spent nuclear fuel process and fabrication equipment, without spreading inside the hot-cell.

12 Claims, 10 Drawing Sheets

REMOTE-CONTROLLED MOBILE CLEANING APPARATUS FOR REMOVAL AND COLLECTION OF HIGH RADIOACTIVE WASTE DEBRIS IN HOT-CELL

BACKGROUND OF THE INVENTION

1. Field of the Invention

The present invention relates to a mobile cleaning device for remotely removing and collecting high radioactive waste debris in a highly radioactive environment of hot-cell for treating and fabricating high radioactive material of spent nuclear fuel, which direct human access to the in-cell is limited to the strictest minimum and is sometimes even impossible. The device operated by remote control moves to the desired cleanup location removes, sucks, and collects loose dry spent nuclear fuel powder and other high radioactive waste debris adhered to both the contaminated in-cell floor and various spent nuclear fuel process and fabrication equipment without spreading inside the hot-cell, thereby maintaining the desired soundness of the hot-cell facility and improving workers' safety by completely eliminating workers' exposure to high-radioactive contaminants.

2. Description of the Prior Art

Known well to those skilled in the art the treatment and fabrication of high radioactive materials such as spent nuclear fuel requires to be carried out inside a completely shielded hot-cell. As the hot-cell is active, workers can't access the in-cell because of the nature of the high radioactivity of spent nuclear fuel. Even personnel in specified radiological turnouts are allowed limited access to the in-cell only when its radiation level is below an allowable one. Undesirable products such as spent nuclear fuel powder debris and contaminated wastes are inevitably created during the spent nuclear fuel treatment and fabrication processes. These products are deposited on both the in-cell floor and the surface of various process equipment located inside the hot-cell, thus contaminating the hot-cell steady. Such radioactive waste needs to be cleaned periodically to prevent the contamination from spreading inside the hot-cell.

In the prior art the removal and collection of radioactive waste debris from both the in-cell floor and the surfaces of the equipment are accomplished by using a conventional vacuum cleaner. However; such a conventional vacuum cleaner to be used in a hot-cell has several problems of remote control, maintenance, and repair. The materials and components of the conventional vacuum cleaner inside the hot-cell are apt to be easily damaged because of the high radioactivity of spent nuclear fuel. It is not easy for the vacuum cleaner to effectively remove and clean the radioactive waste firmly adhered to the in-cell floor or to be moved to a desired cleaning position either by a crane or a remote manipulator installed inside the hot cell. Even possible, it takes much time to transfer the vacuum cleaner to a desired cleaning target. The performance and efficiency of the conventional vacuum cleaner are also reduced due to its limited workspace inside the hot-cell. The storage bag of such a vacuum cleaner undesirably leaks the collected fine radioactive waste into the in-cell atmosphere, thus further spreading the contamination over the in-cell. In addition, it is very difficult to remotely replace a storage bag of the cleaner with a new one or to remotely treat and dispose the collection bag by maneuvering a manipulator or other appropriate tools in situ. Direct exchange of the used bag for a new one by a worker in a specified radiological turnout inside the hot-cell may not be possible to complete the task within a predetermined limited time and may thus cause to expose the worker to excessive radiation, thereby resulting in severe safety problems.

In case of which the conventional vacuum cleaner located inside the hot-cell is damaged or broken, it is not possible to repair or exchange it by a remote means. Therefore, the damaged or broken vacuum cleaner is kept within the hot cell. This undesirably increases the amount of the in-cell radioactive waste, proliferates the contamination level of the hot-cell, increases the cost of radioactive waste treatment and disposal, and degrades the operational function of the hot-cell. In addition, the spent nuclear fuel or special nuclear material requires to be measured in its quantity before and after specified processes inside the hot-cell for nuclear material control and accounting, so that its lost quantity during the processes is evidently identified. Such loss measurement, however, can't be accomplished accurately because the conventional vacuum cleaner can't effectively collect the radioactive waste inside the hot-cell.

SUMMARY OF THE INVENTION

The present invention has been made to solve the above-described problems occurring in the prior art, an object of the invention is to provide a remote-controlled mobile cleaning device, which will be employed in a hazardous environment to which direct human access is impossible.

Another object of the invention is to provide a remote-controlled mobile cleaning device capable of remotely cleaning the hot-cell floor and in-cell process and fabrication equipment contaminated with radioactive materials in a highly radioactive environment of hot-cell in which spent nuclear fuel is handled and fabricated, while completely eliminating worker's exposure to high-radioactive contaminants.

Still another object of the invention is to provide a remote-controlled mobile cleaning device capable of remotely collecting loose dry spent nuclear fuel debris and other radioactive waste without proliferating the contamination level of the in-cell, thereby maintaining a desired soundness of the hot-cell facility.

In order to accomplish the above object, the present invention provides a remote-controlled mobile cleaning device for the collection of high-radioactive waste debris in hot-cell comprising: a navigation means for climbing over such obstacles as electrical cables and pneumatic tubes placed on the hot-cell floor, suction and collections means for dislodging, filtering, and capturing high radioactive waste debris, and cover means for protecting suction and collection means. The device that is operated by remote control moves to a desired cleanup and collection position, cleans, and collects loose dry spent nuclear fuel debris and other high-radioactive waste adhered to contaminated in-cell floor or process and fabrication equipment, without spreading contaminants inside the hot-cell.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Referring to drawings, a remote-controlled mobile cleaning device for removal and collection of high radioactive waste debris in a hot-cell in accordance with the present invention is described.

Figure 1:
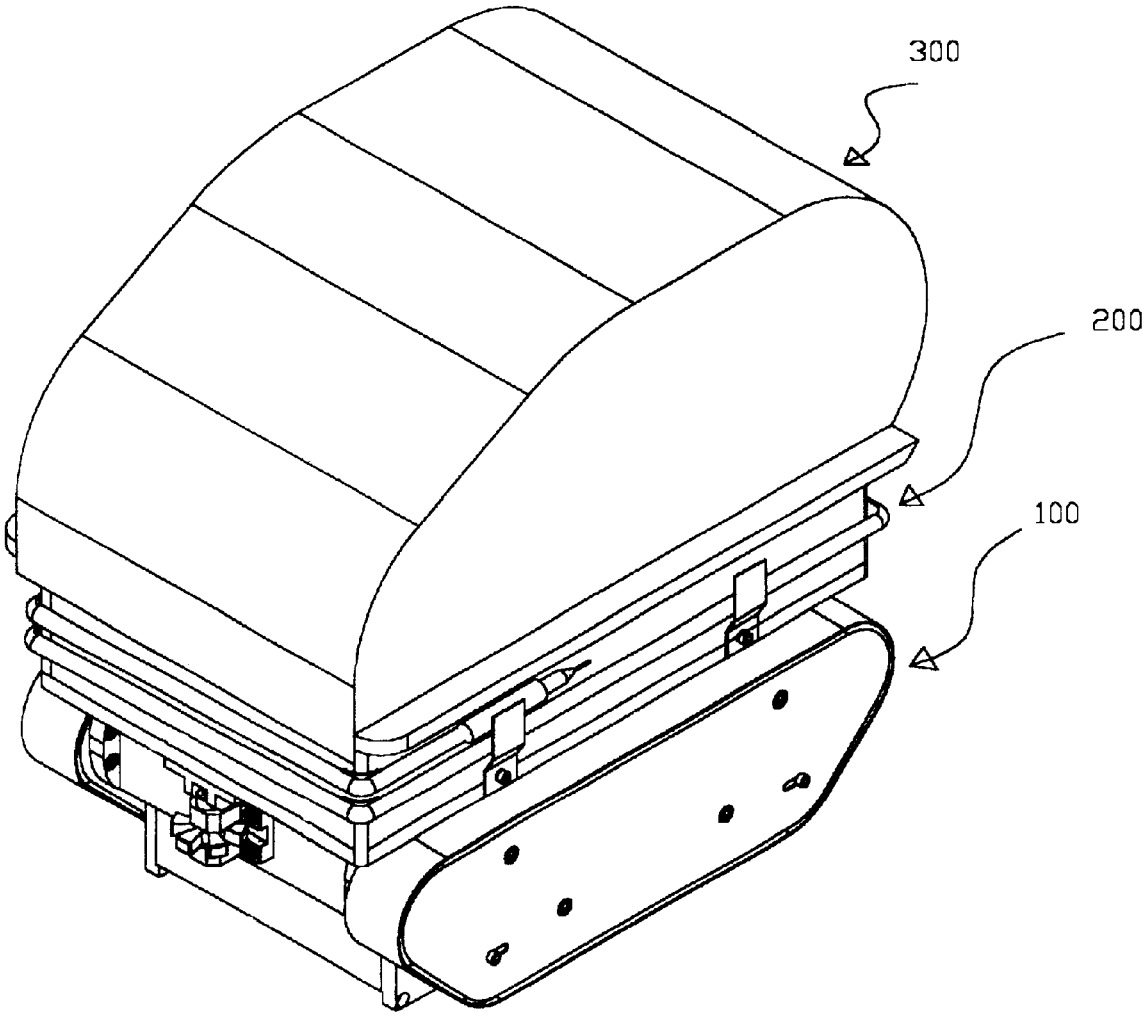
FIG. 1 is a perspective view of the apparatus of the invention.

As shown in FIG. 1, the remote-controlled mobile cleaning device comprises a navigation means 100, a suction and collection means 200, and a cover means 300. The navigation means 100 is a movable part of the device, which moves on a hot-cell floor with climbing over such obstacles as electrical cables and gas tubes placed on the floor. The suction and collection means 200 mounted on the navigation means 100 dislodges, sucks, and captures radioactive waste debris. The cover means 300 mounted to the top of the suction and collection means 200 protects the suction and collection means 200 from external impact or contaminants.

Figure 2:
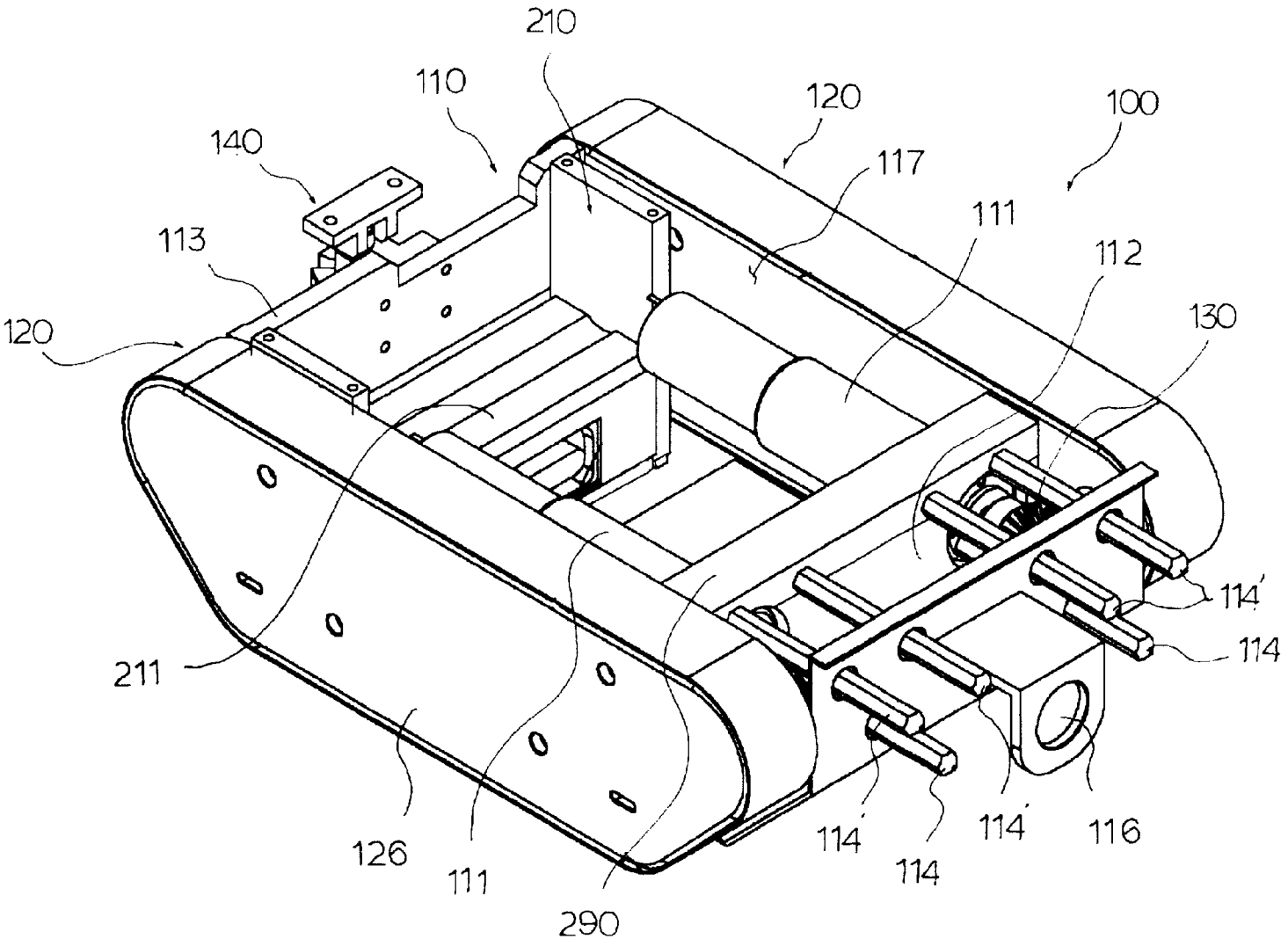
FIG. 2 is a perspective view of the navigation means provided in the apparatus of the invention.
Figure 3:
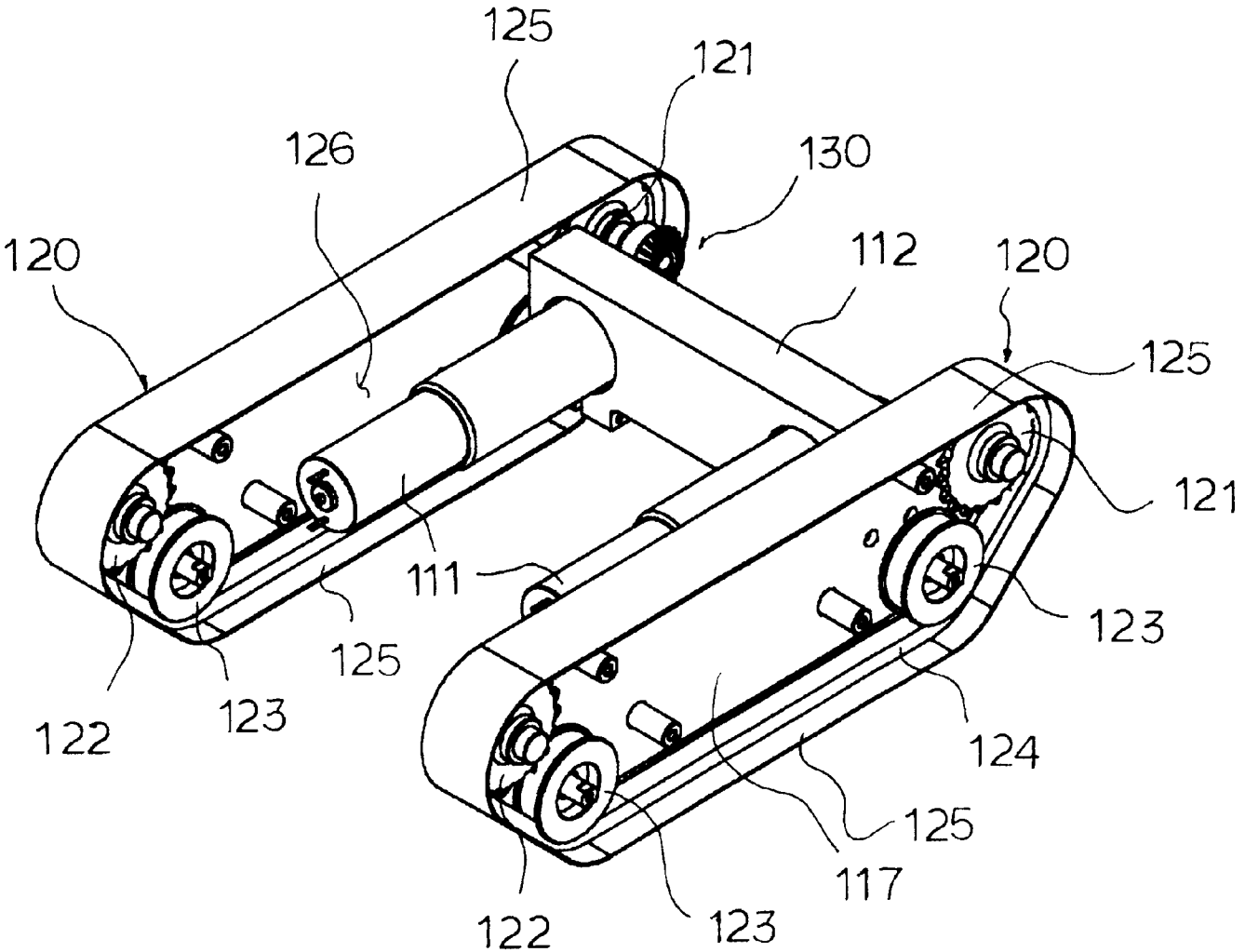
FIG. 3 is a perspective view of the mobile body unit included in the navigation means of FIG. 2.
Figure 4:
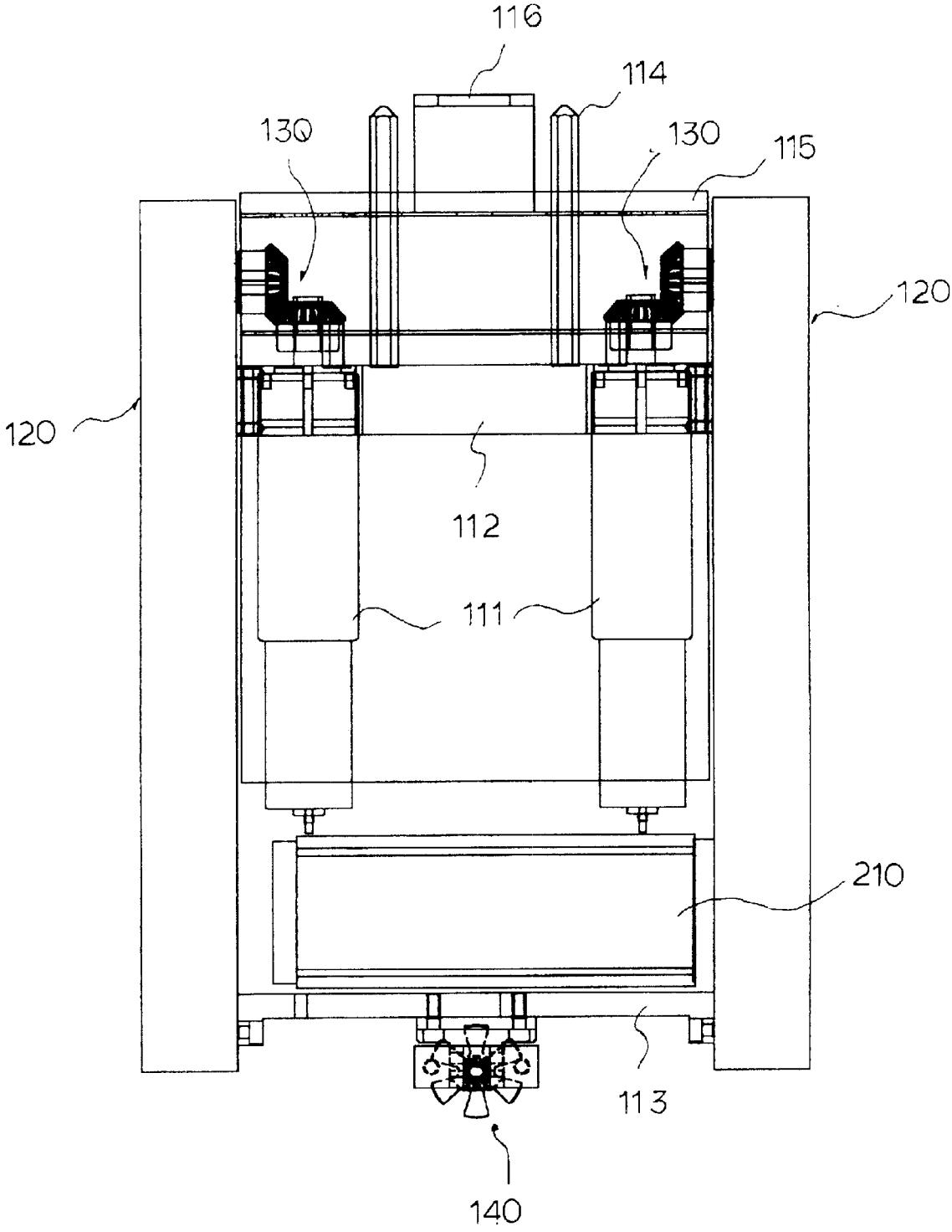
FIG. 4 is a plan view of the navigation means provided in the apparatus of the invention shown in FIG. 2.

As shown in FIGS. 2, 3 and 4, the navigation means 100 comprises a mobile body unit 110 carrying two drive motors 111, two caterpillar units 120 provided at opposite sides of the mobile body unit 110, and two bevel gear units 130 which connect the output shafts of the two drive motors 111 to the drive sprockets 121. Each bevel gear unit 130 comprises two bevel gears engaged with each other. Of the two bevel gears, the first one is fixed to the output shaft of an associated drive motor 111, and the second one fixed to an associated drive sprocket 121. When the drive motor 111 is activated, the torque of the drive motor 111 is transmitted to the associated drive sprocket 121 connected to the associated caterpillar unit 120 through the associated bevel gear unit 130, thus allowing the associated caterpillar unit 120 to be operated in conjunction with the associated drive motor 111.

Figure 7:
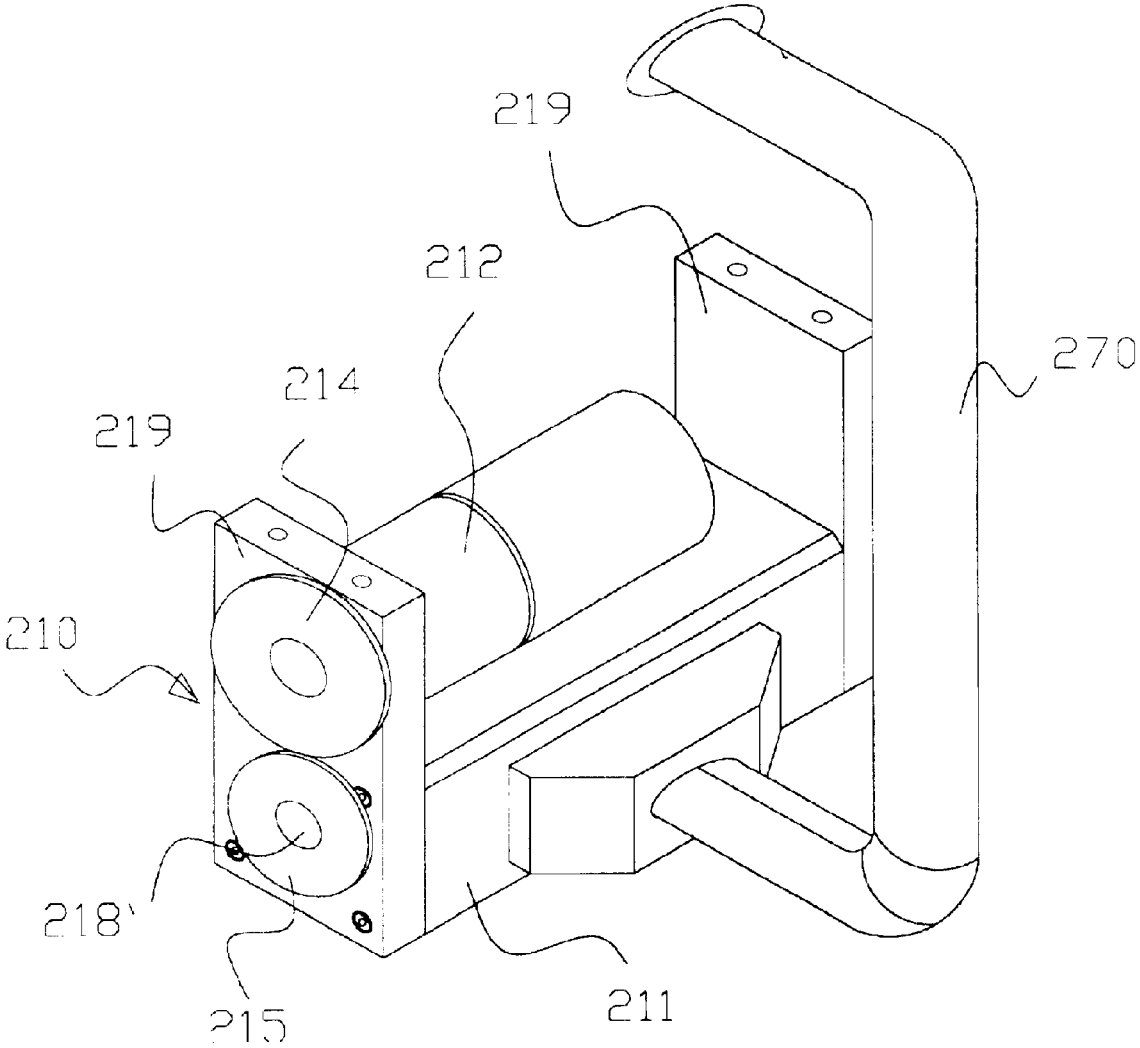
FIG. 7 is a perspective view of the primary suction unit for the suction and collection means provided in the apparatus of the invention.

As shown in FIG. 2, the mobile body unit 110 has two side support panels 117 at opposite sides thereof and holds each caterpillar unit 120 at the corresponding support panel 117. Both a main support beam 112 and a front support beam 113 are installed in parallel between the two side support panels 117. The main support beam 112 also supports the two drive motors 111 thereon. As shown in FIG. 7, the body support plate 115 positioned at the end of the mobile body unit 110 is mounted to the main support beam 112 using the locking bolts 114 at a certain height spaced apart from the surface of a hot-cell floor such that, when the navigation means 100 moves on the hot-cell floor, the body support plate 115 doesn't contact with the floor surface to be cleaned, thereby without contaminating the body support plate 115 with radioactive contaminants. A bracket 116, having an installation opening, is mounted to the body support plate 115 and allows an electrical connector (not shown) to be installed on the mobile body unit 110 in order to supply power to the two drive motors 111. In such a case, the electrical connector (not shown) for the two drive motors 111 can be installed on or removed from the mobile body unit 110 using a manipulator (not shown) in a remote manner.

As best shown in FIG. 3, the two caterpillar units 120 are provided encircling outside the two side support panels 117 of the mobile body unit 110. Each caterpillar unit 120 comprises a drive sprocket 121, a driven sprocket 122, a plurality of track guide rollers 123, and a track 125 engaged with a chain 124. The drive sprocket 121 is mounted at a corner of an associated side support panel 117 and is rotated in conjunction with an associated drive motor 111 through an associated bevel gear unit 130. The driven sprocket 122 is mounted at another corner of the side support panel 117 in such a way that it is rotated and positioned on the same horizontal line as that of the drive sprocket 121. A plurality of track guide rollers 123 are provided at appropriate positions between the drive and driven sprockets 121 and 122. The chain 124 is wrapped around the drive and driven sprockets 121 and 122 while passing over the track guide rollers 123. In such a case, a series of teeth of the chain 124, axially formed along the central axis of the inside surface of the track 125, are engaged with the drive and driven sprockets 121 and 122. Both sides of each caterpillar unit 120 are also sealed with a protection plate 126, thus protecting the drive sprocket 121 and the driven sprocket 122, the track support rollers 123, and the chain 124 from radioactive contaminants. Such arrangements of the caterpillar unit 120 make the navigation means 100 possible to climb over such obstacles as electrical cables and pneumatic tubes placed on the hot-cell floor to be cleaned.

The navigation means 100 allows the cleaning device of this invention to carry out forward, reverse and steering movements. Such motions of the cleaning device are controlled by the velocity difference of the two driving motors 111. By remote control from a control console (not shown) located outside the hot-cell the cleaning device moves to the desired cleaning location in-cell by activating the driving motors 111.

Figure 5:
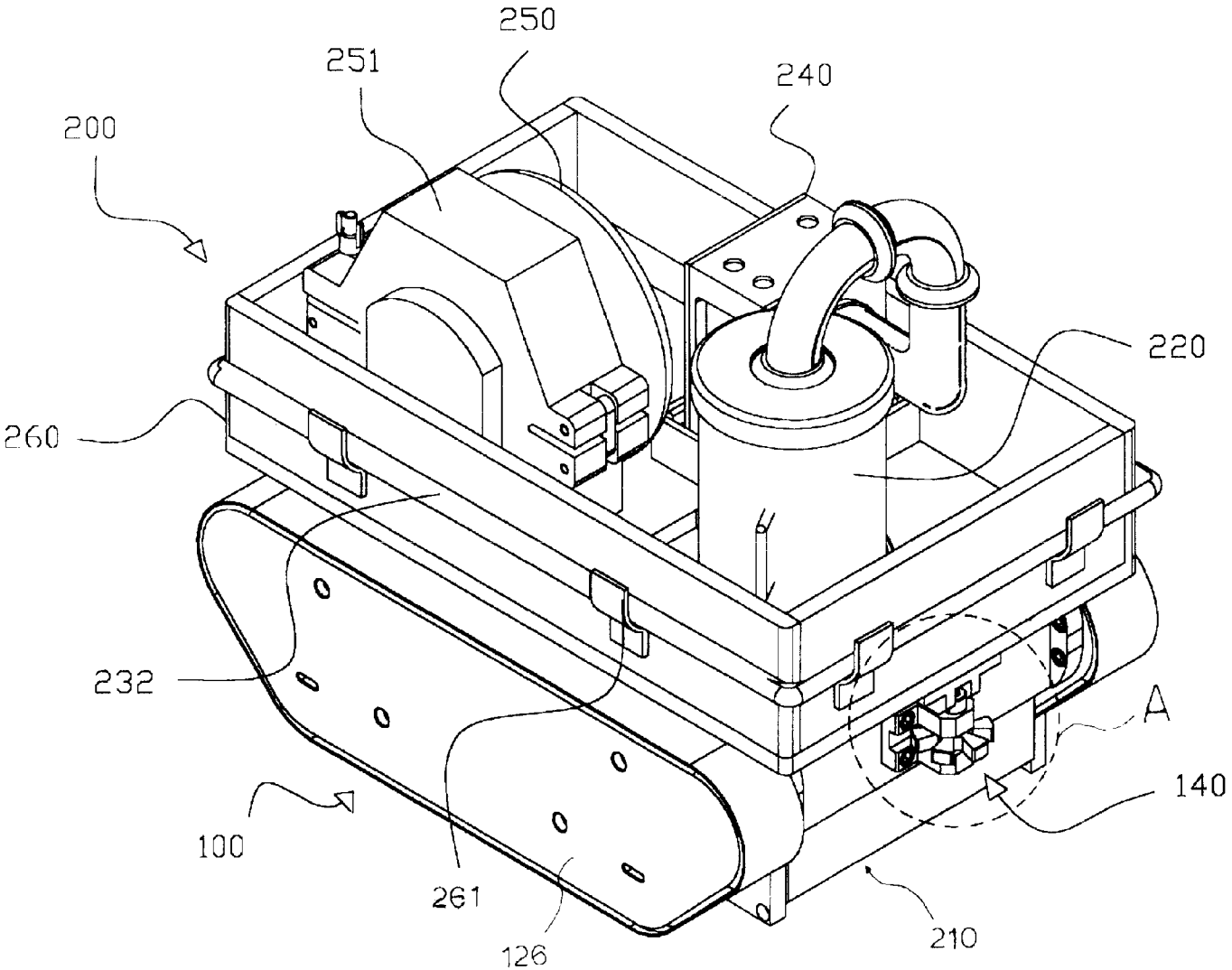
FIG. 5 is a perspective view of the apparatus of the invention from which the cover means is removed.
Figure 6:
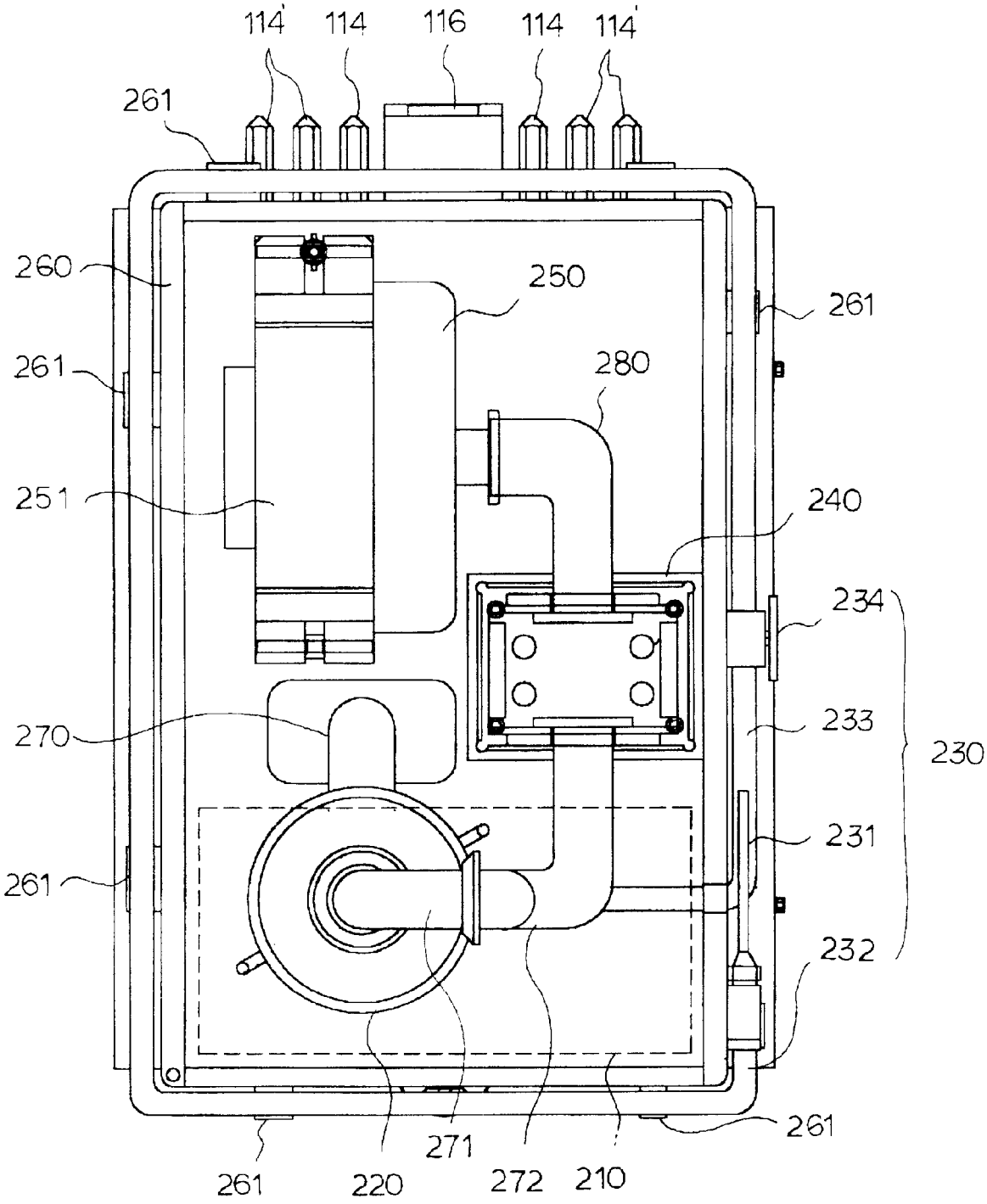
FIG. 6 is a plan view of the suction and collection means provided in the apparatus of the invention shown in FIG. 5.

As shown in FIGS. 5 and 6, the suction and collection means 200 installed on the navigation means 100 cleans and stores radioactive waste debris scattered on a hot-cell floor. The suction and collection means 200 comprises a primary suction unit 210, a flexible suction unit 230, a primary collection unit 220, a secondary collection unit 240, a blower unit 250, and a housing 260. The primary suction unit 210 and the flexible suction unit 230 are connected to the primary collection unit 220 which is also connected to the secondary collection unit 240 and a blower unit 250 in sequence. The primary suction unit 210 dislodges and sucks radioactive waste debris placed on the surface of the hot-cell floor, while the primary collection unit 220 captures and stores the radioactive waste debris sucked by the primary suction unit 210. The flexible suction unit 230 is used to suck radioactive waste debris in areas to which the primary suction unit 210 can't access. More fine radioactive waste debris filtered from the primary collection unit 220 is also captured and stored by the secondary collection unit 240 which is connected to the blower unit 250 through a fourth pipe 280. The blower unit 250 generates suction force for sucking radioactive waste debris into the primary and secondary collection units 220 and 240 through the primary and flexible suction units 210 and 230. The blower unit 250 is held in its place within the housing 260 by a clamp 251. A pipe connector (not shown), provided with a sealing ring (not shown), is set at each of the junctions between a first feed pipe 270 and the primary collection unit 220, between a second feed pipe 271 and a third feed pipe 272, and between a fourth feed pipe 280 and the blower unit 250. Each connector prevents an undesired leakage of the sucked radioactive waste debris or the contaminated air from the junctions during the operation of the cleaning device. The above-mentioned units comprising the suction and collection means 200 are constructed in modules to allow remote operation and maintenance to be effected using manipulators or auxiliary tools (not shown) located inside the hot-cell, and they can be separated and assembled easily by remote manipulation.

Figure 8:
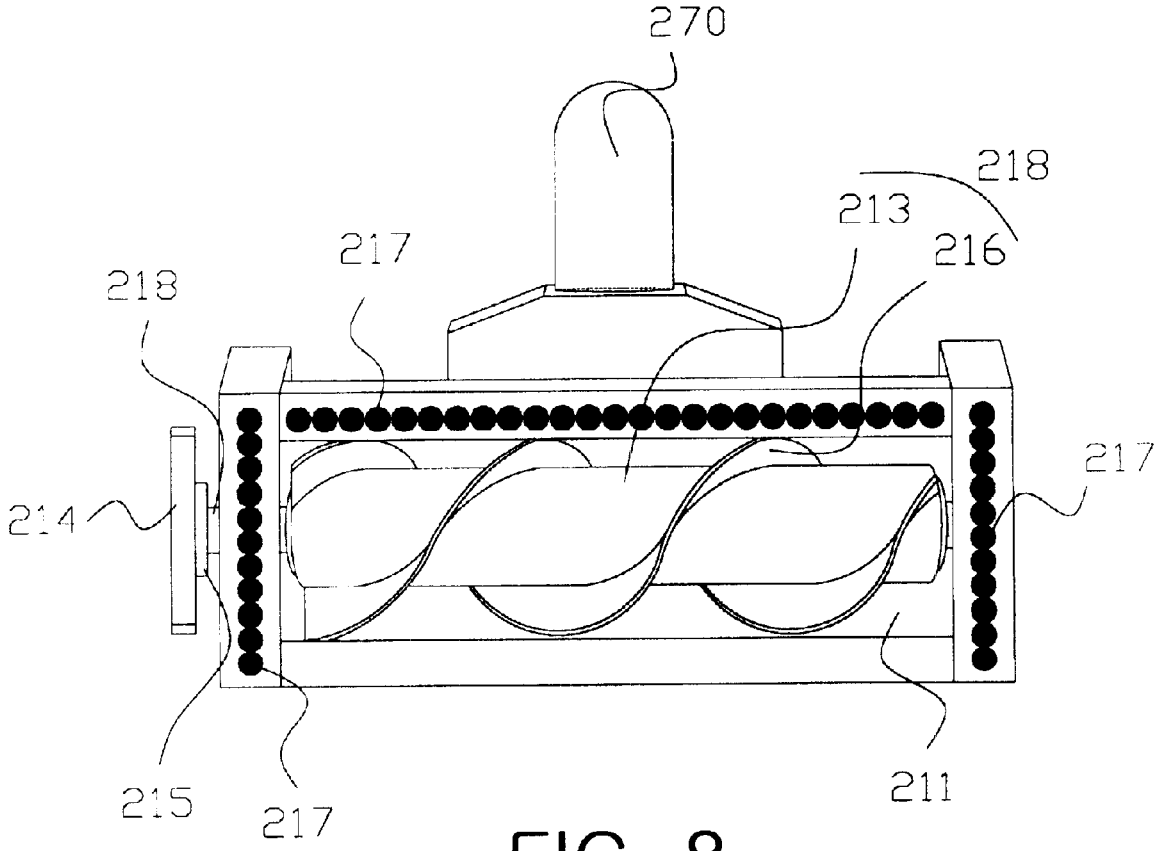
FIG. 8 is a bottom view of FIG. 7.

As shown in FIGS. 5, 7 and 8, the primary suction unit 210 firmly fixed to the front bottom of the housing 260 by vertical supports 219 consists of a brush roller 218 and a suction port 211 housing the brush roller 218. The suction port 211 is connected to the primary collection unit 220 through the first feed pipe 270. The brush roller 218 is made of a cylindrical bar 213 inserted with a bundle of thin bronze strings 216 in a double spiral shape. The driven gear 215, mounted to the output shaft of the brush roller 218, engages with the drive gear 214 mounted to the output shaft of the drive motor 212, and thus the brush roller 218 is rotated by the torques of the drive motor 212 transmitted thereto through the two gears 214 and 215. When the brush roller 218 rotates during cleaning operation, both soft and hard contaminated materials deposited on the hot-cell floor are dislodged by the rotation of the thin bronze strings 216, and the vacuum provided by the blower unit 250 then effectively removes and collects them. Such arrangement of the brush roller 218 in conjunction with the blower unit 250 improves the suction ability of the primary suction unit 210. A fringe 217, made of a bundle of thin bronze strings, is installed around the base of the suction port 211 in the form of a rectangle with opening in moving direction so that the suction port 211 can easily pass over obstacles placed on the hot-cell floor. The bottom end of the fringe 217 and the end of the bronze strings 216 of the brush roller 218 are lined up so that they are always in contact with the floor surface during a cleaning operation. Such aligned fringe 217 prevents the dislodged waste from spreading outside the suction port 211.

As best seen in FIG. 6, the flexible suction unit 230 is used to clean up areas where the primary suction unit 210 is inaccessible or on surface of the equipment located inside the hot-cell. The flexible suction unit 230 connected to the primary collection unit 220 comprises a suction nozzle 231 having a predetermined length, a flexible hose 232 extended from the suction nozzle 231 and connected to a control valve 234, a connection horse 233 extended from the control valve 234. The flexible hose 232 is held around the outer sides of the housing 260 by a plurality of holders 261. The control valve 234 fixed to the outer side of the housing 260 is mounted at the junction between the flexible hose 232 and the connection horse 233. For cleanup operation by the flexible suction unit 230, the manipulator (not shown) in a remote manner grasps the suction nozzle 231, removes it 231 from the holders 261 and guides it 231 to a desired cleaning position. The blower unit 250 is then activated for cleaning after the control valve 234 is turned on using a manipulator (not shown).

Figure 9:
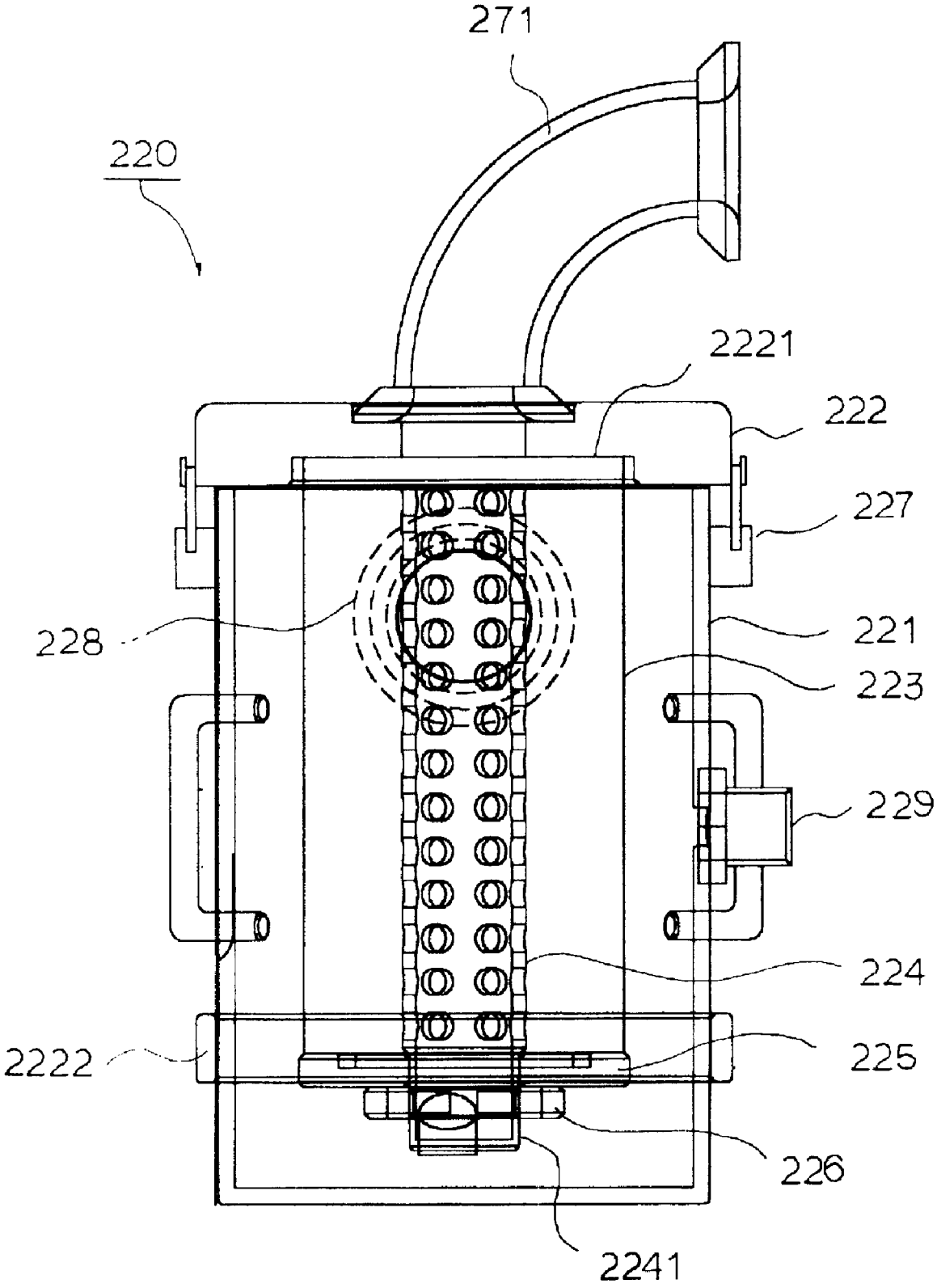
FIG. 9 is a schematic view of the primary collection unit for the suction and collection means provided in the apparatus of the invention.

As shown in FIG. 9, the primary collection unit 220 comprises a storage case 221 that has a circular plate 2222 at the lower part by which the storage case 221 can sit on the interior of the housing 260. A sealing cap 222 includes a perforated conduit pipe 224 and a cylindrical ceramic filter 223. The top end of the perforated conduit pipe 224 is firmly fixed to the center hole of the sealing cap 222 and therefrom to the second feed pipe 271. The cylindrical ceramic filter 223 encircles the perforated conduit pipe 224, and its top end is engaged with the sealing cap 222 at the depression 2221 with predetermined depth. The bottom end of the cylindrical ceramic filter 223 is covered with a lower support member 225 that passes through the lower part of the perforated conduit pipe 224. The bottom of the cylindrical ceramic filter 223 and the lower support member 225 is tightly sealed by fastening a locking nut 226 through a thread 2241 made on the lower part of the perforated conduit pipe 224, thereby making the ceramic filter 223 to be held below the sealing cap 222. The ceramic filter 223 and the perforated conduit pipe 224 are concentrically positioned with respect to the center hole of the sealing cap 222. The sealing cap 222 is installed on the top end of the storage case 221 and completely covers the storage case 221 by fastening a plurality of clamps 227 mounted on the upper outer surface of the storage case 221. When the primary collection unit 220 is assembled, the interior of the cylindrical ceramic filter 223 is completely isolated from the interior of the storage case 221, thus providing a room for collecting high radioactive waste debris. The storage case 221 also has two connection ports 228 and 229, of which the first one 228 is connected to the first feed pipe 270 of the primary suction unit 210, while the second one 229 is connected to the connection hose 233 of the flexible suction unit 230.

The radioactive waste debris, which is sucked either through the primary suction unit 210 or through the flexible suction unit 230 during the operation of the cleaning apparatus, is transmitted to the primary collection unit 220 through the first feed pipe 270 and is primarily filtered by the ceramic filter 223. The waste debris filtered off by the ceramic filter 223 is then effectively collected in the space made between the interior of the storage case 221 and the exterior of the ceramic filter 223. Only a small amount of more fine waste debris filtered from the ceramic filter 223 is introduced into the secondary collection unit 240 through both the second and third feed pipes 271 and 272 in sequence, and is then captured by the secondary collection unit 240. The filtered air from the secondary collection unit 240 is fed into the blower unit 250 through the fourth feed pipe 280 and then is exhausted into the atmosphere inside the hot-cell.

In case of which the storage case 221 is filled up with spent nuclear fuel powder or high radioactive waste debris, the primary collection unit 220 can be easily disassembled inside the hot-cell using a manipulator (not shown) in a remote manner. The primary collection unit 220 can be also assembled with ease after transferring the radioactive waste debris collected in the storage case 221 to a waste drum for disposal. In such a way of collecting high radioactive waste and transferring it other depository, it is possible to identify the loss of nuclear spent fuel in the high radioactive material handling and treatment process by measuring the quantity of the collected radioactive waste debris. The secondary collection unit 240 can be also exchanged for new one easily in a remote manner when necessary.

As shown in FIG. 5, the housing 260 cases and supports the primary and flexible suction units 210 and 230, the primary and secondary collection units 220 and 240, and the blower unit 250. An electrical connector (not shown) provided at the rear-wall of the housing 260 is used to remotely supply power to both the drive motor 212 of the primary suction unit 210 and the blower unit 250. One side of the connection plate 290 mounted on the rear bottom of the housing 260 is connected to the main support beam 112 of the navigation means 100 by a plurality of locking bolts 114' that pass through the support plate 115, shown in FIG. 2.

Figure 10:
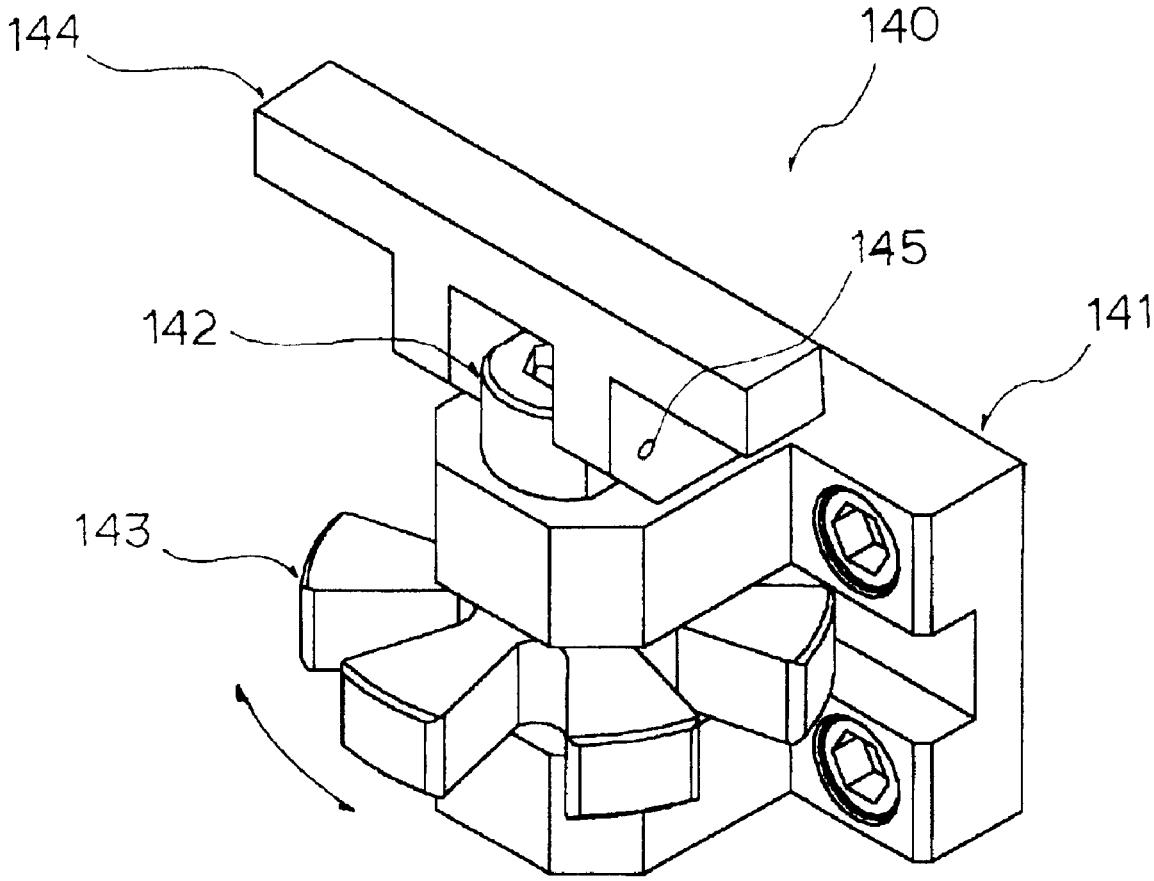
FIG. 10 is an enlarged view of the circle A of FIG. 5.

In case of which the bronze strings 216 of the brush roller 218 of the primary suction Unit 210 are abraded for long use and fail to come into close contact with a floor surface to be cleaned, it needs to lower the ends of the bronze strings 216 downward. Such adjustment can be accomplished by controlling the housing 260. An adjustable locking unit 140 adjusts the height of the housing 260 so that the bronze strings 216 are always in contact with the hot-cell floor surface to be cleaned. As best seen in FIG. 10, the adjustable locking unit 140 comprises an upper holder 144, which is mounted on the front bottom of the housing 260 and has a downward channel. An adjustable bolt 142 is set by a pin 145 within the downward channel of the upper holder 144, thus enabling the adjustable bolt 142 to swing with respect to the pin 145. In addition, an adjusting holder 141, having upper and lower bosses with a horizontal channel defined between the two bosses, is horizontally mounted to the outer surface of the end support beam 113. The adjustable bolt 142 is also vertically held by the two bosses of the adjusting holder 141, while a fan-shaped adjusting nut 143, having an internally-threaded central opening, is engaged with the adjustable bolt 142 at a position between the two bosses of the adjusting holder 141. The channel of the adjusting holder 141 prevents the adjusting nut 143 from being unexpectedly removed from its desired horizontal position. The adjustable bolt 142 engaged with the upper holder 144 primarily passes down through the upper boss of the adjusting holder 141, and secondarily passes through the central opening of the adjusting nut 143 prior to being finally inserted into the lower boss of the adjusting holder 141. The gap between the end of the bronze strings 216 of the brush roller 218 and the floor surface to be cleaned is controlled by rotating the fan-shaped adjusting nut 143 in a clockwise or counter-clockwise direction. Fastening the fan-shaped adjusting nut 143 engaged with the adjustable bolt 142 in a clockwise direction lowers down the housing 260 and the primary suction unit 210 relative to the hot-cell floor surface and makes the end of the bronze strings 216 to be in contact with the floor surface.

The suction and collection means 200 is assembled with the navigation means 100 by both the locking bolts 114' at the rear and the adjustable locking unit 140 at the front When necessary, the suction and collection means 200 can be easily separated from the navigation means 100 by loosening both the locking bolts 114' and the adjusting bolt 142 through remote manipulation.

In the cleaning device of this invention, the navigation means 100, the suction and collection means 200, and the cover means 300 are constructed in modules, which can be easily assembled and disassembled. Each module can be replaced with a new one easily by using a manipulator (not shown) in a remote manner when necessary.

As described above, the present invention provides a remote-controlled mobile cleaning apparatus for use in a spent nuclear fuel process and fabrication area, such as a hot-cell, where humans are inaccessible due to the high radiation level of a spent nuclear fuel. The cleaning device of ties invention can dislodge, suck, collect, and remove the highly radioactive waste debris deposited both on the hot-cell floor and on the surface of the in-cell equipment. All functions for controlling the cleaning device of this invention remotely are contained within a control console (not shown) located outside the hot-cell. A human operator located from out-of-cell controls, via the control console (not shown), the cleaning device located in-cell in order to perform the in-cell cleaning tasks. Such remote control for the cleaning device makes it possible for the human operator to be located at a safe, nonhazardous location nearby.

The cleanup operations of the hot-cell contaminated with high radioactive materials using the cleaning device of this invention have the benefits of improved worker safety, increased facility soundness, and reduced personnel exposure dose rates.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A remote-controlled mobile cleaning apparatus for removing and collecting highly contaminated radioactive waste debris deposited on the hot-cell floor and the surface of spent nuclear fuel process and fabrication equipment located on said hot-cell floor where humans are inaccessible due to the high radiation level of spent nuclear fuel, comprising:

a navigation means provided at a lower portion of said apparatus for moving on a surface of said hot-cell floor;

a suction and collection means connected with the navigation means for dislodging, sucking and collecting highly contaminated radioactive waste debris; and a cover part mounted on the top of the suction and collection means so as to cover and protect the suction and collection means, wherein said suction and collection means comprises:

a primary suction unit to dislodge and suck radioactive waste debris adhered to the surface of the hot-cell floor;

a flexible suction unit to clean up areas where the primary suction unit is inaccessible or the surface of the equipment located on the hot-cell floor;

a primary collection unit to firstly filter and store radioactive waste debris sucked both by the primary suction unit and by the flexible suction unit;

a secondary collection unit to filter and capture more fine radioactive waste debris filtered from the primary collection unit;

a blower unit to generate a suction force for the suction and collection means; and a housing holding all of the above units, whereby each unit is separately constructed in modules and connected to each of said other units by first, second, third, and fourth feed pipes in sequence.

2. A remote-controlled mobile cleaning apparatus as defined in claim 1, wherein said primary suction unit comprises:

a brush roller made of a cylindrical bar inserted with a bundle of thin bronze strings in a double spiral shape;

a suction port housing the brush roller, wherein fringe made of a bundle of thin bronze strings is inserted at the base of said suction port in the form of a rectangle;

a drive motor installed at a position above the suction port; and a plurality of gears connecting the output shaft of the brush roller with the one of the drive motor, thus making the brush roller rotate in conjunction with the drive motor.

3. A remote-controlled mobile cleaning apparatus as defined in any one of claims 1 and 2, wherein the navigation means and the suction and collection means are assembled or disassembled only by use of both an adjustable locking unit at the front and a plurality of locking bolts at the rear.

4. A remote-controlled mobile cleaning apparatus as defined in claim 3, wherein said adjustable locking unit comprises:

an upper holder mounted to the front bottom of the housing of the suction and collection means, wherein said upper holder has a downward channel;

an adjustable bolt vertically set by a pin within the downward channel of the upper holder, thus enabling said adjustable bolt to swing with respect to the pin;

an adjusting holder mounted to the outer surface of the front support beam of the mobile body unit, wherein said adjusting holder has upper and lower bosses with a horizontal channel defined between the two bosses; and a fan-shaped adjusting nut having internally-threaded central opening, wherein said fan-shaped adjusting nut is engaged with the adjustable bolt at a position between the upper and lower bosses of the adjusting holder.

5. A remote-controlled mobile cleaning apparatus as defined in claim 4, wherein the adjustable locking unit controls the gap between the end of the bronze strings of the brush roller and the hot-cell floor surface to be cleaned by rotating the fan-shaped adjusting nut engaged with the adjustable bolt in a clockwise or counter-clockwise direction, and wherein fastening the fan-shaped adjusting nut in a clockwise direction lowers down both the housing and the primary suction unit relative to the hot-cell floor surface and makes the end of the bronze strings of the brush roller to be in contact with the floor surface.

6. A remote-controlled mobile cleaning apparatus as defined in claim 4, wherein the adjustable bolt engaged with the upper holder primarily passes through the upper boss of the adjusting holder downward, and secondarily the central opening of the fan-shaped adjusting nut prior to being finally inserted into the lower boss of the adjusting holder, thus completing the adjustable locking unit.

7. A remote-controlled mobile cleaning apparatus as defined in claim 6, wherein the adjustable locking unit controls the gap between the end of the bronze strings of the brush roller and the hot-cell floor surface to be cleaned by rotating the fan-shaped adjusting nut engaged with the adjustable bolt in a clockwise or counter-clockwise direction, and wherein fastening the fan-shaped adjusting nut in a clockwise direction lowers down both the housing and the primary suction unit relative to the hot-cell floor surface and makes the end of the bronze strings of the brush roller to be in contact with the floor surface.

8. A remote-controlled mobile cleaning apparatus as defined in claim 3, wherein the adjustable locking unit controls the gap between the end of the bronze strings of the brush roller and the hot-cell floor surface to be cleaned by rotating the fan-shaped adjusting nut engaged with the adjustable bolt in a clockwise or counter-clockwise direction, and wherein fastening the fan-shaped adjusting nut in a clockwise direction lowers down both the housing and the primary suction unit relative to the hot-cell floor surface and makes the end of the bronze strings of the brush roller to be in contact with the floor surface.

9. A remote-controlled mobile cleaning apparatus as defined in claim 1, wherein said flexible suction unit comprises:

a suction nozzle having a predetermined length;

a flexible hose connected to the suction nozzle;

a connection hose extended from a control valve and connected to the primary collection unit; and a control valve to control the operation of said flexible suction unit, wherein said control valve connects the flexible hose and the connection hose and is fixedly mounted to the outer side of the housing.

10. A remote-controlled mobile cleaning apparatus as defined in claim 3, wherein said primary collection unit comprises:

a storage case to collect radioactive waste debris sucked either through the primary suction unit or through the flexible suction unit, wherein said storage case has a circular plate at its lower part by which said storage case is sat in the interior of the housing;

a sealing cap covering the top of the storage case completely by fastening a plurality of clamps mounted on the outer surface of the storage case;

a perforated conduit pipe fixed concentrically at a bottom center hole of the sealing cap; and a cylindrical ceramic filter to primarily filter sucked radioactive waste debris, wherein said cylindrical ceramic filter encircles the perforated conduit pipe concentrically.

11. A remote-controlled mobile cleaning apparatus as defined in claim 10, wherein the top end of the cylindrical ceramic filter is engaged with the bottom of the sealing cap at a depression with predetermined depth, wherein the bottom end of the cylindrical ceramic filter is covered with a lower support member that passes through the lower part of the perforated conduit pipe and is tightly sealed with the lower support member by fastening a locking nut through a thread made on the lower part of the perforated conduit pipe, thereby making the ceramic filter to firmly be held below the sealing cap.

12. A remote-controlled mobile cleaning apparatus as defined in claim 10 or 11, wherein the sealing cap assembled with the ceramic filter, the perforated conduit pipe and the lower support member are held on the top of the storage case, and wherein the interior of the ceramic filter is completely isolated from the interior of the storage case, thereby creating a room for collecting radioactive waste debris.

* * * * *